US012571616B2

(12) United States Patent
Dart

(10) Patent No.: US 12,571,616 B2
(45) Date of Patent: Mar. 10, 2026

(54) MINE CLEARING LINE CHARGE DESIGN WITH IMPROVED EFFICIENCY

(71) Applicant: Day & Zimmermann, Inc., Philadelphia, PA (US)

(72) Inventor: Steven Dart, Southlake, TX (US)

(73) Assignee: DAY & ZIMMERMANN, INC., Philadelphia, PA (US)

( * ) Notice: Subject to any disclaimer, the term of this patent is extended or adjusted under 35 U.S.C. 154(b) by 0 days.

(21) Appl. No.: 18/813,468

(22) Filed: Aug. 23, 2024

(65) Prior Publication Data

US 2025/0155225 A1 May 15, 2025

Related U.S. Application Data

(60) Provisional application No. 63/598,783, filed on Nov. 14, 2023.

(51) Int. Cl.
*F41H 11/14* (2006.01)
*F41H 11/16* (2011.01)

(52) U.S. Cl.
CPC ..... *F41H 11/14* (2013.01); *F41H 11/16* (2013.01)

(58) Field of Classification Search
CPC ..... F41H 11/14; F41H 11/16
USPC ..... 102/403
See application file for complete search history.

(56) References Cited

U.S. PATENT DOCUMENTS

| | | | | |
|---|---|---|---|---|
| 4,051,763 | A * | 10/1977 | Thomanek | F41H 5/007 250/222.2 |
| 7,954,433 | B1 * | 6/2011 | Barnett | F42B 1/036 102/307 |
| 8,037,797 | B1 * | 10/2011 | Frank | F41H 11/16 89/1.13 |
| 8,904,937 | B2 * | 12/2014 | Mangolds | F42B 3/00 102/331 |
| 2017/0146325 | A1 * | 5/2017 | Edminster | F41H 11/16 |
| 2025/0155225 | A1 * | 5/2025 | Dart | F41H 11/14 |

OTHER PUBLICATIONS

FUNKER530—Veteran Community & Combat Footage. "Miclic Minefield Clearing in Afghanistan." Uploaded to YouTube.com on Nov. 12, 2011. URL: https://www.youtube.com/watch?v=hEUyAIPBoIE [Retrieved from the Internet: Aug. 22, 2024].

* cited by examiner

*Primary Examiner* — Samir Abdosh
(74) *Attorney, Agent, or Firm* — Troutman Pepper Locke LLP

(57) ABSTRACT

A mine clearing device configured to be propelled into an area and detonated after landing has a detonating cord and a plurality of explosive blocks along the detonating cord. Each of the plurality of explosive blocks is configured such that, upon landing, a majority of the explosive material is between a ground and a horizontal plane of the detonating cord.

20 Claims, 10 Drawing Sheets

MINE CLEARING LINE CHARGE DESIGN WITH IMPROVED EFFICIENCY

CROSS REFERENCE TO RELATED APPLICATIONS

This application claims the benefit of priority of U.S. Provisional Patent Application Ser. No. 63/598,783, filed on Nov. 14, 2023, entitled "Novel Mine Clearing Line Charge Design with Improved Efficiency," the entire contents of which is hereby incorporated by reference herein.

TECHNICAL FIELD

The present invention relates generally to a mine clearing system and, more particularly, to a novel mine clearing line charge design having improved efficiency.

BACKGROUND

A mine clearing line charge ("MICLIC") is a device that can be used to clear a path for tanks, vehicles, and personnel through minefields and areas with other obstacles. They can be effective against single pulse, pressure fuzed mines.

Conventional MICLICs are be made of a series of explosive square prism blocks, each with a central hole that carries a detonating cord. The blocks can be made of a composition C-4 explosive and can be formed by two half blocks, each weighing about 600 grams (1.32 lbs). A conventional MICLIC can be 350 feet long and contain five pounds per linear foot of composition C-4 explosive.

A MICLIC can be propelled over a minefield by, e.g., a Mk22 5-inch rocket motor, and detonated to clear a path that is one vehicle wide lane (e.g., eight meters wide) that is about 100 meters long. The explosion of the MICLIC clears a path by detonating mines in the closest proximity to it and blowing other mines out of the path.

As mentioned above, conventional explosive blocks are in the shape of square prisms with a hole extending from the center of one face of the explosive block to the center of the opposite face.

Because the charge is initiated in the center, 50% of the detonation shock wave, in the square prism configuration, is directed upwards above the midpoint plane and does not contribute to the pressure pulse directed downward to the buried mines.

An improved design is desired. An ideal design has a higher percentage of explosive composition below the charge and a greater contact area to improve energy transfer into the ground, without changing the weight, length, or volume, of the convention explosive block.

The present disclosure is directed to overcoming these and other problems of the prior art.

SUMMARY

Embodiments of the present invention address and overcome one or more of the above shortcomings and drawbacks, by providing systems, methods, and devices related to a novel mine clearing line charge design with improved efficiency.

In an exemplary embodiment, a mine clearing device configured to be propelled into an area and detonated after landing has a detonating cord and a plurality of explosive blocks along the detonating cord. Each of the plurality of explosive blocks is configured such that, upon landing, a majority of the explosive material is between a ground and a horizontal plane of the detonating cord.

In some embodiments, one or more of the explosive blocks have a triangular prism shape. In some embodiments, each of the explosive blocks has a plurality of segments that together form a respective explosive block. In some embodiments, the triangular prism shape has a first rectangular face, a second rectangular face, and a third rectangular face, and the first and second rectangular faces are curved inward such that there is less volume above a centroid plane parallel with the third rectangular face.

In some embodiments, each explosive block forms therethrough an aperture through which the detonating cord extends, and wherein the aperture extends from a first triangular face a respective explosive block to a second triangular face of the respective explosive block. In some embodiments, the aperture extends from a first location of the first triangular face to a second location on the second triangular face. The first location is at one of a first centroid and between the first centroid and a first corner, and the second location is at one of a second centroid and between the second centroid and a second corner.

In some embodiments, each of the plurality of explosive blocks further have a plurality of loops arranged along an edge of the explosive block through which the detonating cord extends, and the mine clearing device further has one or more parachutes configured such that each of the plurality of explosive blocks is configured to land on a face opposite of the edge. In some embodiments, one or more of the parachutes is a rectangular parachute vane extending over two or more of the plurality of explosive blocks. In some embodiments, the one or more parachutes is a plurality of parachutes, each of the plurality of parachutes extending over only a respective one of the plurality of explosive blocks. In some embodiments, the mine clearing device further has a sleeve surrounding each of the plurality of explosive blocks and a fabric vane having one end thereof attached to the sleeve to cause drag as the mine clearing device falls to the ground.

In another exemplary embodiment, a method of manufacturing a mine clearing device to be propelled into an area and detonated after landing includes preparing a plurality of explosive blocks by an extrusion process and arranging each of the plurality of explosive blocks along a detonating cord. Each of the plurality of explosive blocks have a triangular prism shape.

In some embodiments, preparing one of the plurality of explosive blocks includes extruding a plurality of segments that together form a triangular prism with an aperture that extends from a first centroid at a first triangular face to a second centroid at a second triangular face, and each of the plurality of explosive blocks are arranged along the detonating cord by securing the plurality of segments together about the detonating cord such that the detonating cord extends through the aperture. In some embodiments, each of the plurality of segments are substantially identical.

In some embodiments, the method further includes attaching a plurality of loops on an edge of each of the explosive blocks, placing a sleeve around each of the plurality of explosive blocks, and attaching one or more parachutes to the sleeve such that the one or more of the plurality of explosive blocks is configured to land on a face opposite the edge. Each of the plurality of explosive blocks is arranged along the detonating cord by extending the detonating cord through each of the plurality of loops of each of the explosive blocks. In some embodiments, one of the one or more parachutes is a rectangular parachute vane, and the one or more parachutes are attached to one or more of the plurality of explosive blocks by attaching the rectangular parachute vane to the sleeve such that the rectangular parachute vane extends over the at least two of the plurality of explosive blocks. In some embodiments, the method further includes placing a sleeve around each of the plurality of explosive blocks and attaching one end of a fabric vane to the sleeve to cause drag as the mine clearing device falls to the ground.

In yet another embodiment, an explosive block for use in a mine clearing line charge device to be propelled into an area and detonated after landing includes a block in a triangular prism shape, configured to be arranged along a detonating cord, and including an explosive.

In some embodiments, the block forms therethrough an aperture through which the detonating cord can extend. The aperture extends from a first location of a first triangular face to a second location on a second triangular face. The first location is at one of a first centroid and between the first centroid and a first corner, and the second location is at one of a second centroid and between the second centroid and a second corner. In some embodiments, the block further has a plurality of loops arranged along an edge of the explosive block through which the detonating cord can extend. In some embodiments, the triangular prism shape has a first rectangular face, a second rectangular face, and a third rectangular face, and the first and second rectangular faces are curved inward such that there is less volume above a centroid plane parallel with the third rectangular face.

This summary is provided to introduce a selection of concepts in a simplified form that are further described below in the detailed description. This summary is not intended to identify key features or essential features of the claimed subject matter, nor is it intended to be used to limit the scope of the claimed subject matter. Additional features and advantages of the disclosed technology will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION

The present disclosure describes a novel mine clearing line charge design with improved efficiency. It can be challenging to design an explosive block for an MICLIC that can be propelled into the air and land such that more of the explosive is between the ground and the detonating cord than above the detonating cord. The present disclosure discloses at least two embodiments that address this challenge.

In the first embodiment, the explosive block is in the shape of a triangular prism and a detonating cord extends from the centroid of its first triangular face to the centroid of its second triangular face. Because of the geometry of a triangular prism, more than half of the explosive will be located between the ground and the detonating cord, regardless of which rectangular face of the triangular prism lands on the ground. With more explosive between the ground and the detonating cord, a greater explosion will result.

In the second embodiment, the explosive block can be in the shape of any prism. Like the first embodiment, a detonating cord extends from the prism's first face to its second face. Unlike the first embodiment, the detonating cord is located above the center/centroid plane of the explosive blocks. Each explosive block has a parachute that will control its landing to ensure that the explosive block lands with the "right side up," with the detonating cord located above the center/centroid plane of the explosive block.

Figure 1A:
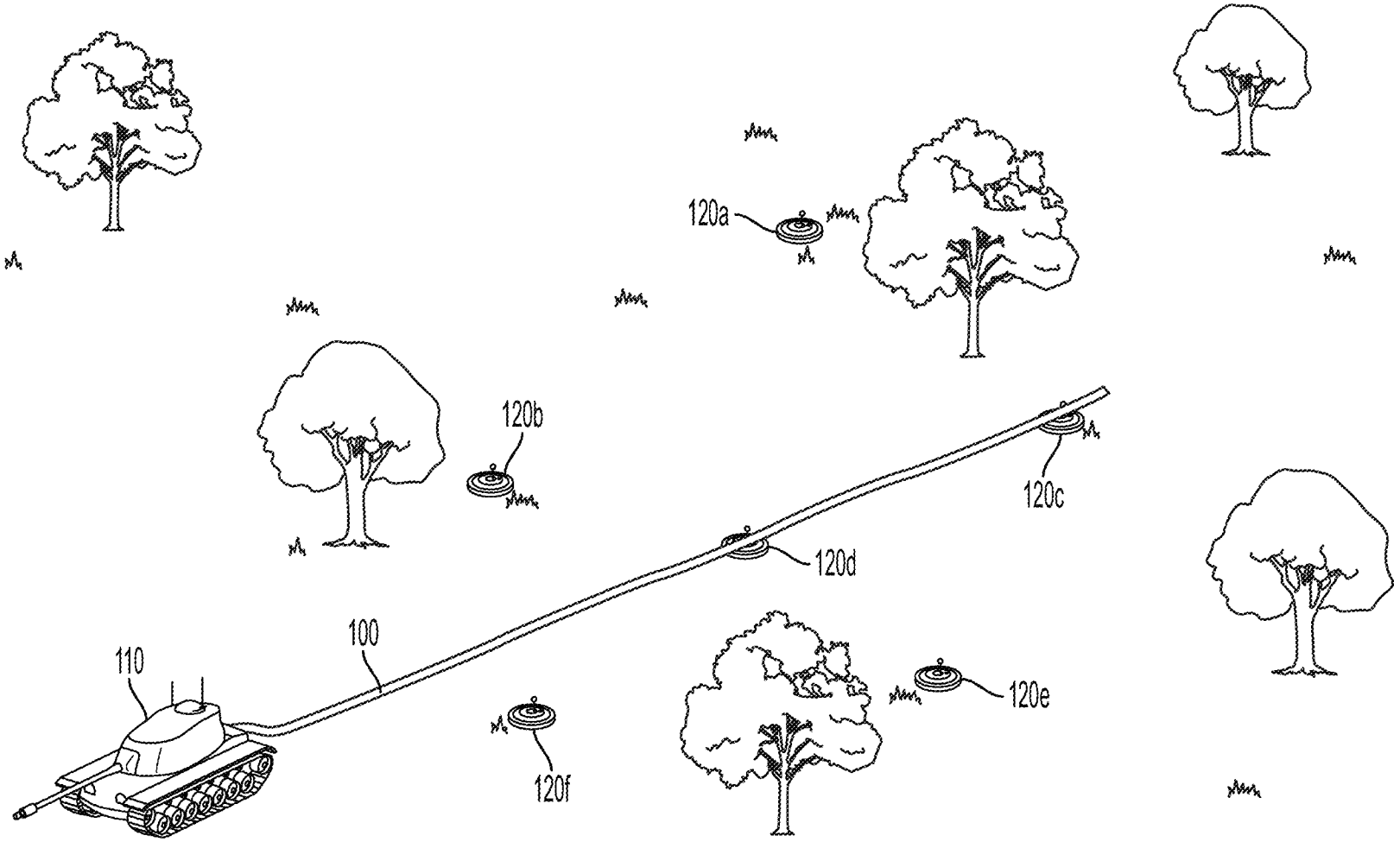
FIG. 1A is an illustration of a minefield after a MICLIC is deployed but before it is detonated, according to an embodiment of the present disclosure.

FIG. 1A is an illustration of a minefield after a MICLIC 100 is deployed but before it is detonated, according to an embodiment of the present disclosure. As illustrated in FIG. 1A, a vehicle 110 carrying a MICLIC 100 has traveled to an area with mines 120. The MICLIC 100 was propelled into the air and landed in the minefield.

Figure 1B:
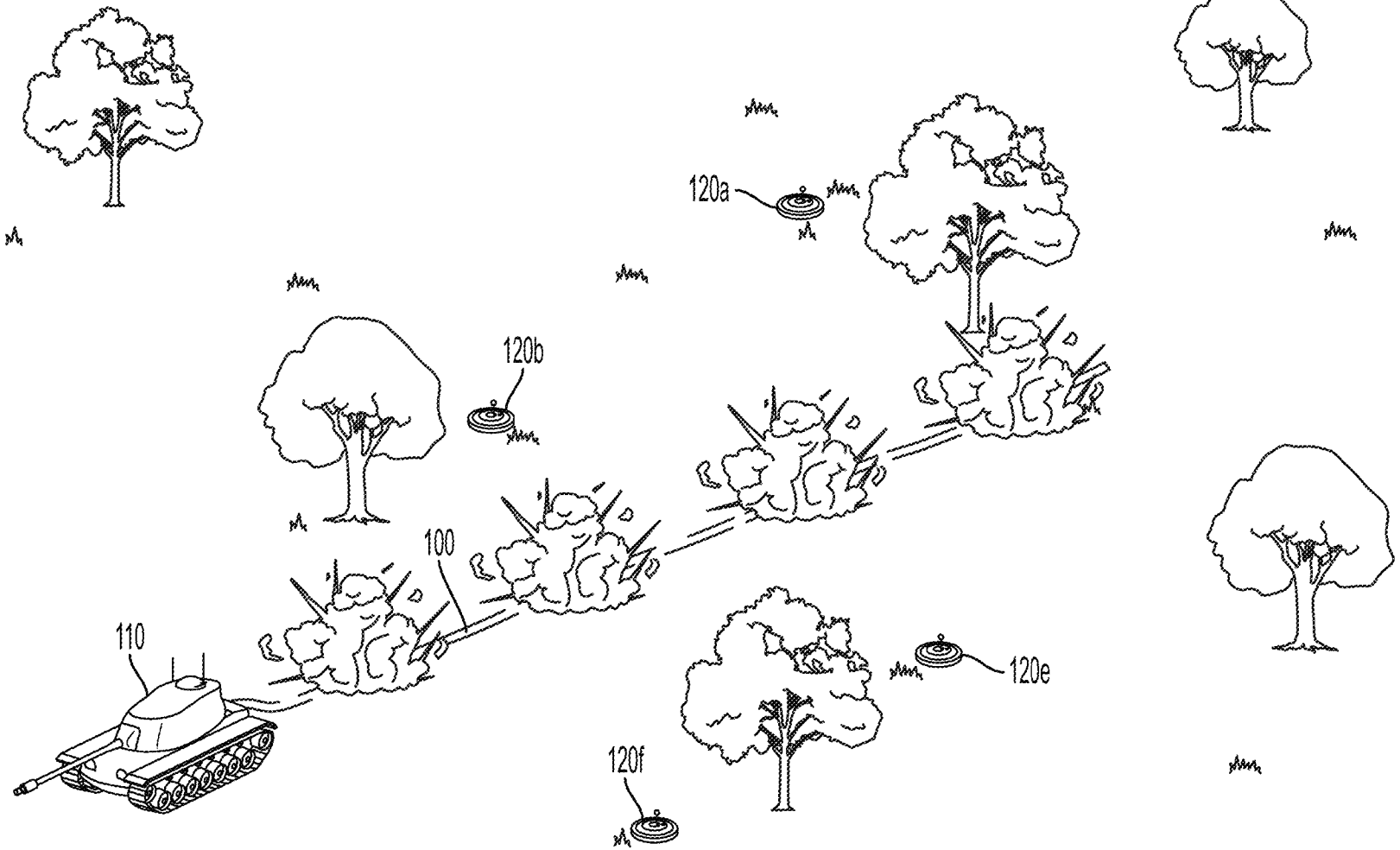
FIG. 1B is an illustration of a minefield after the MICLIC shown in FIG. 1A is detonated, according to an embodiment of the present disclosure.

FIG. 1B is an illustration of a minefield after the MICLIC 100 shown in FIG. 1A is detonated, according to an embodiment of the present disclosure. As shown in FIG. 1B, the explosion of the MICLIC's 100 explosive blocks detonated mines 120*d* and 120*c* and blew mines 120*b* and 120*f* away. As a result, a path is created through which the vehicle 110 can travel.

Figure 2B:
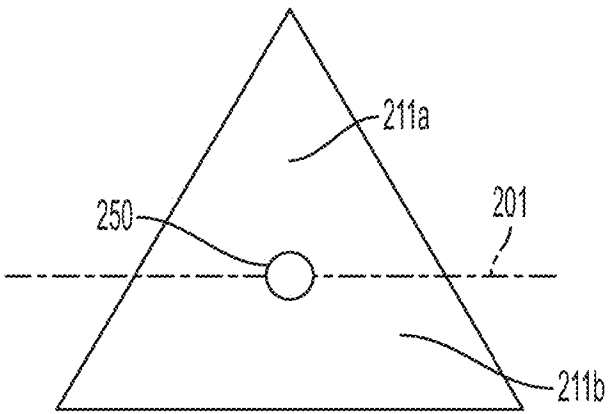
FIGS. 2A and 2B are various views of an explosive block having the shape of a triangular prism, according to an embodiment of the present disclosure.
Figure 2A:
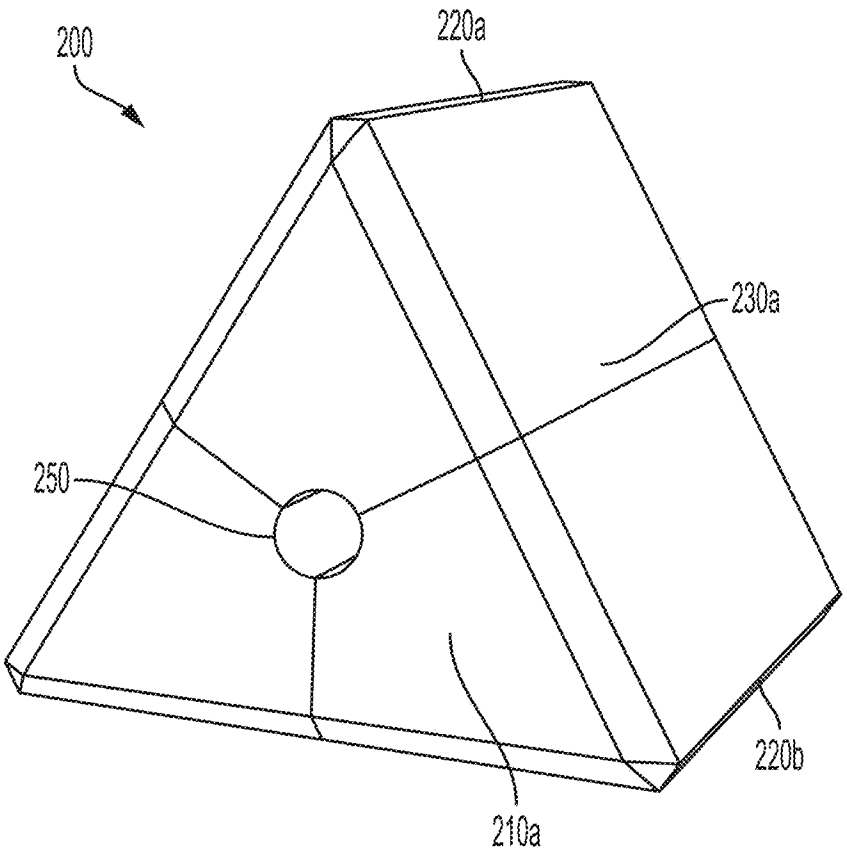

As mentioned above and as will be described as follows with references to FIGS. 2A-6H, in the first embodiment, an explosive block 200 can have the shape of a triangular prism, with a detonating cord 300 extending through it from the centroid of its first triangular face to the centroid of its second triangular face. FIGS. 2A and 2B are various views of an explosive block 200 having the shape of a triangular prism, according to an embodiment of the present disclosure. Referring to FIG. 2A, the explosive block 200 has two triangular faces (one of which is shown as 210*a*), three rectangular faces (one of which is shown as 230*a*), and three edges (two of which are shown—220*a* and 220*b*). The explosive block 200 has a hole 250 that extends from the centroid of its first triangular face 210*a* to its second.

FIG. 2B is a front view of an explosive block 200 having the shape of a triangular prism, according to an embodiment of the present disclosure. In FIG. 2B, line 201 is drawn at the triangle's centroid's horizontal plane. When the explosive block 200 lands, the explosive material above the centerline 211*a* will be directed upwards and will not contribute to the pressure pulse directed downward to the buried mines. In contrast, the explosive material below the centerline 211*b* will contribute to the pressure pulse directed downward to the buried lines. Because of its geometry, regardless upon which rectangular face 230 the explosive block 200 lands, the volume of explosive material below the centerline 211*b* will be greater than the volume of explosive material above the centerline 211*a*.

Figure 3A:
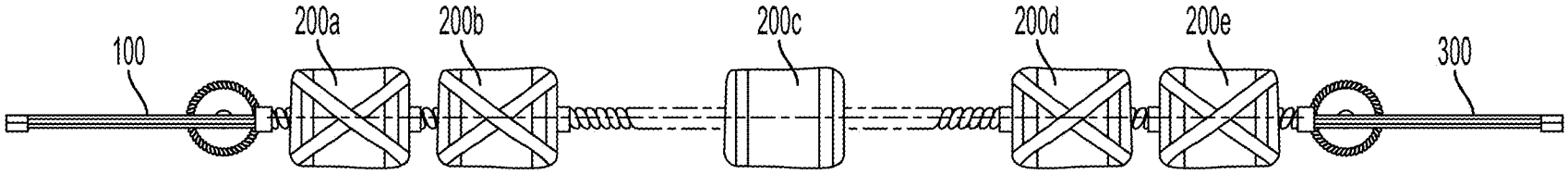
FIGS. 3A-3C are various views of a MICLIC, according to an embodiment of the present disclosure.
Figure 3B:
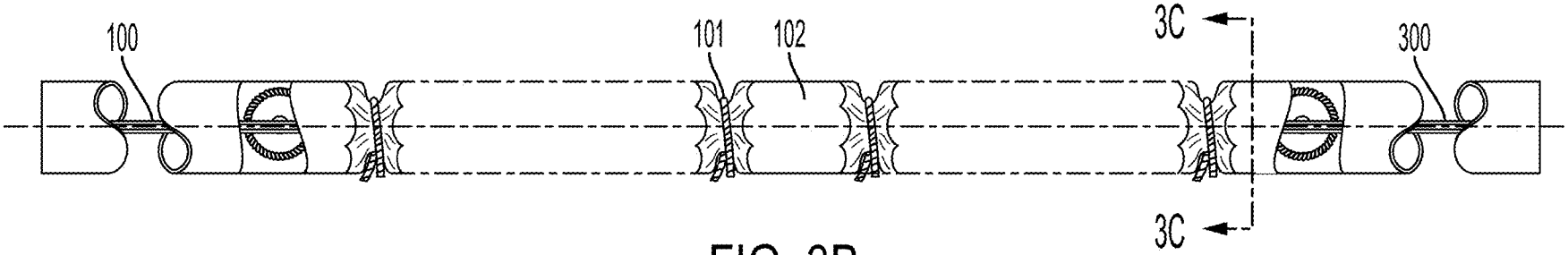
Figure 3C:
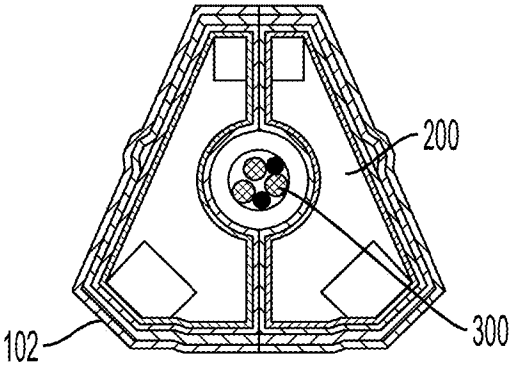

FIGS. 3A-3C are various views of a MICLIC 100, according to an embodiment of the present disclosure. The explosive blocks 200 described above with respect to FIGS. 2A and 2B can be used to create a MICLIC 100, such as the one illustrated in FIGS. 3A-3C. As illustrated in FIGS. 3A-3C, in some embodiments, a MICLIC 100 can include a series of explosive blocks 200 thread along a detonating cord 300.

Referring to FIG. 3B, in some embodiments, a sleeve 102 can be placed over the explosive blocks 200 and the detonating cord of the detonating cord 300. In some embodiments, the sleeve 102 can comprise fabric or other flexible material. In some embodiments, one or more fasteners 101 can be used to "pinch" the sleeve between explosive blocks 200. In some embodiments, a fastener is placed between each explosive block 200. In other embodiments, a fastener is placed every two or more explosive blocks 200. In other embodiments, a combination approach is used: the sleeve 102 is "pinched" on either side of one or more explosive blocks 200 and the sleeve 102 is not pinched between at least two adjacent explosive blocks 200. The sleeve 102, alone and together with the fasteners 101, can be beneficial to hold the MICLIC system 100 together.

Figure 4:
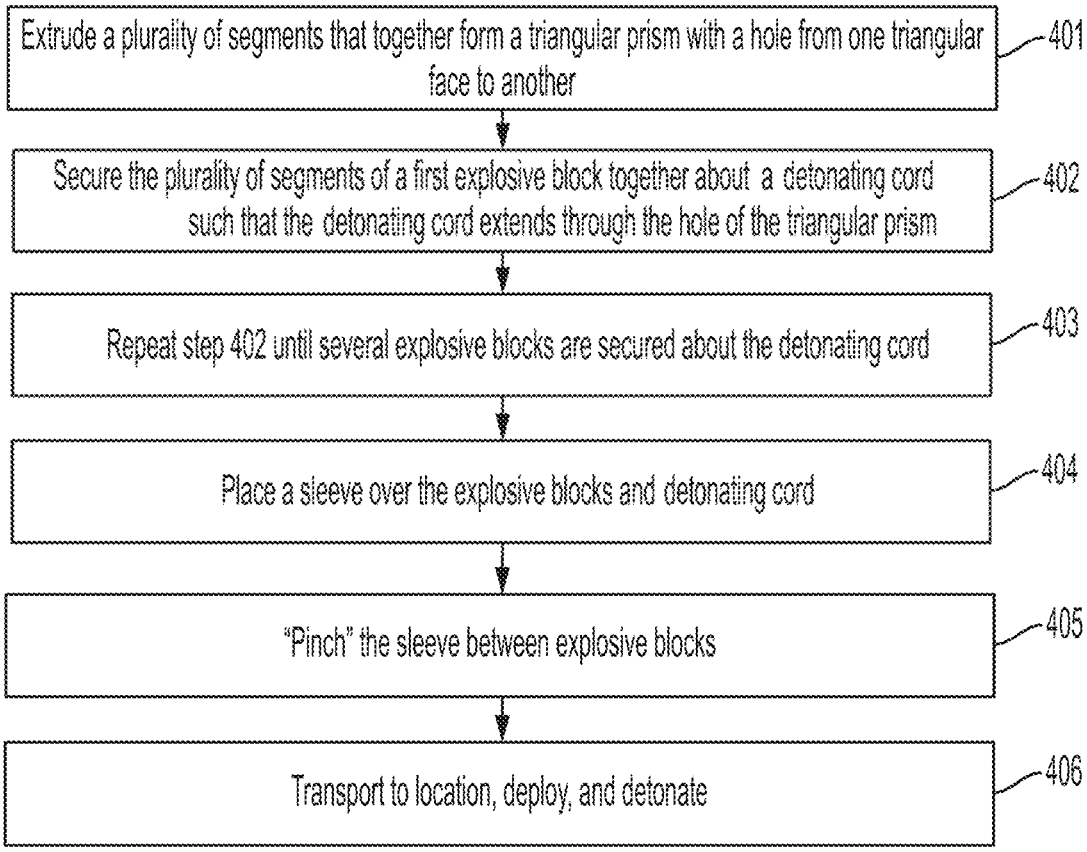
FIG. 4 is a flow chart of a method of manufacturing a MICLIC, according to an embodiment of the present disclosure.
Figure 5B:
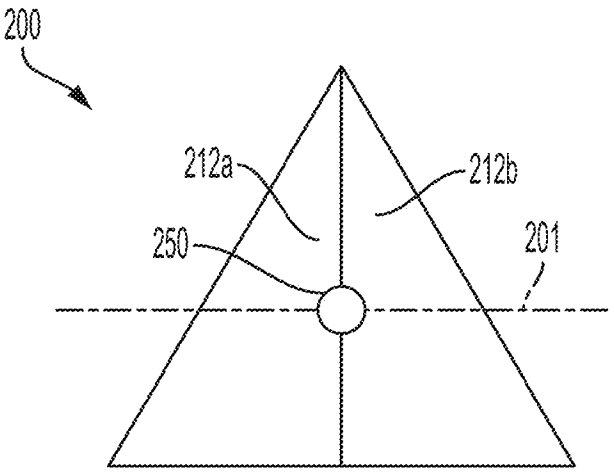
FIGS. 5A and 5B are different embodiments of a triangular prism explosive block formed of two or more segments, according to an embodiment of the present disclosure.
Figure 5A:
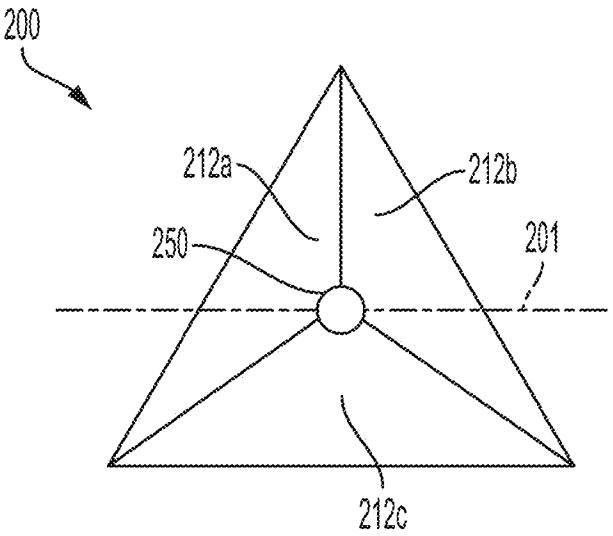

FIG. 4 is a flow chart of a method of manufacturing a MICLIC 100, according to an embodiment of the present disclosure. At step 401, the method 400 can include extruding a plurality of segments 212 that together form a triangular prism 200 with a hole from one triangular face to another. FIGS. 5A and 5B are different embodiments of a triangular prism explosive block. As illustrated in FIGS. 5A and 5B, the triangular prism may be formed by two (FIG. 5A) or three (FIG. 5B) identical segments. However, as one of ordinary skill in the art will appreciate, the subject matter disclosed here is not so limited; the triangular prism may be formed of greater or fewer segments, and one or more of the segments may or may not be identical to one another.

In some embodiments, the segments may be formed of a composition containing C-4 and/or other explosives. In some embodiments, an explosive stronger than C-4 is used.

At step 402, the method 400 can include securing the plurality of segments 212 of a first explosive block 200 together about a detonating cord 300 such that the detonating cord 300 extends through the hole 250 of the triangular prism 200. In some embodiments, the segments 212 can be secured together by placing material (e.g., a plastic bag) around the segments 212 and taping the material around the triangular prism 200. However, as one of ordinary skill in the art will appreciate, the subject matter disclosed herein is not so limited. Instead, many other ways to secure the segments 212 are possible, including, for example, securing them with an adhesive.

At step 403, the method 400 can include repeating step 402 until several explosive blocks 200 are secured about the detonating cord 300. In some embodiments, like a conventional MICLIC, an assembled MICLIC 100 according to the present disclosure can be 350 feet long and contain five pounds per linear foot of composition C-4 explosive.

At step 404, the method 400 can optionally include placing a sleeve over the explosive blocks 200 and detonating cord 300. At step 405, the method 400 can optionally include using fasteners to "pinch" the sleeve between explosive blocks 200, as discussed above with respect to FIG. 3B.

Once assembled, the MICLIC 100 can be loaded be loaded onto a vehicle, transported to a minefield (or any area with obstacles), propelled into the minefield, and detonated to clear a path. In some embodiments, the MICLIC 100 can be propelled into the minefield using a rocket motor, e.g., a Mk22 5-inch rocket motor.

In some embodiments, a fuze is used. A fuze is a device to transfer the ignition "signal" to the detonator. In some embodiments, there is a fuze at the end of the MICLIC 100 that when fired initiates a detonator, this detonation (shock wave) is transmitted and maintained by the detonating cord. In some embodiments, although more expensive, an electronically initiated detonator is used in each charge/explosive block 200 (or at the apex of each charge/explosive block) and initiated with an electronic signal.

In some embodiments, the number and volume of explosive blocks 200 can be selected such that detonation of the MICLIC 100 clears a path of a specified length and width. For example, in some embodiments, the MICLIC can clear a path that is about 100 feet long and about one-vehicle-wide (e.g., eight meters wide). As mentioned above, the explosions of the MICLIC's 100 explosive blocks 200 clear a path by detonating mines in its closest proximity and blowing other mines away.

Figure 6A:
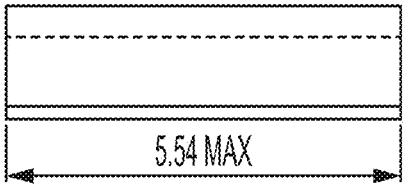
FIGS. 6A-6H are side-by-side comparisons of a conventional square prism explosive block and the triangular square prism explosive block disclosed herein, according to an embodiment of the present disclosure.
Figure 6B:
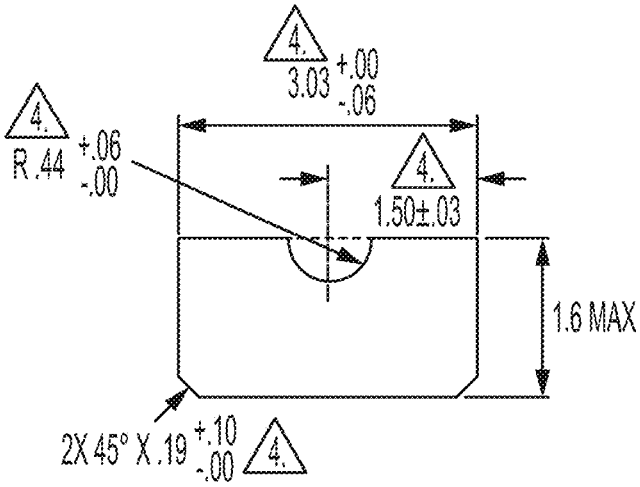

FIGS. 6A-6H are side-by-side comparisons of a conventional square prism explosive block and the triangular square prism explosive block disclosed herein, according to an embodiment of the present disclosure. A study of these figures illustrates some advantages of an explosive block having a triangular prism shape when compared to a conventional block having a square prism shape. FIGS. 6A and 6B illustrate a conventional block to which an explosive block of the present disclosure is compared.

Figure 6C:
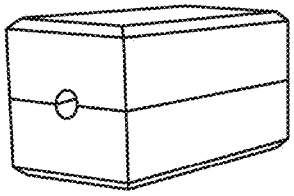
Figure 6D:
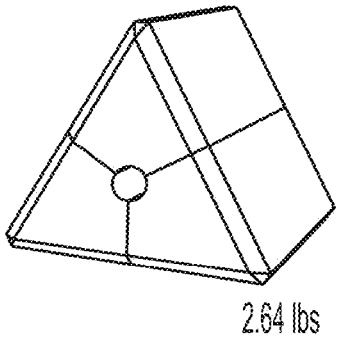

As illustrated by FIGS. 6C and 6D, although the geometry of a square prism is different than a triangular prism, the weight, length, and volume can be the same. This can be beneficial because existing material and methods may not have to change to use the explosive blocks 200. For example, conventional sleeves 102 and propelling rockets can be used with the subject matter disclosed herein.

Figure 6E:
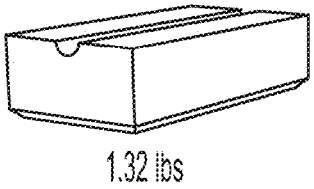
Figure 6F:
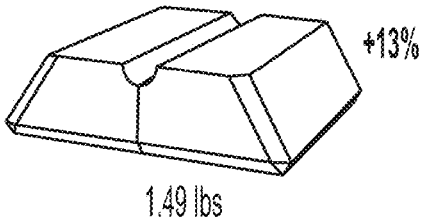
Figure 6G:
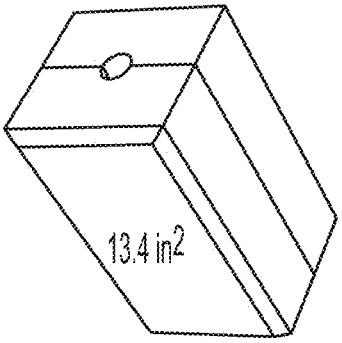
Figure 6H:
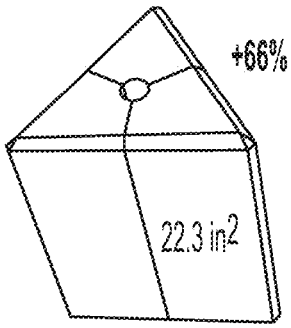

As illustrated in FIG. 6E, because the charge is initiated in the center, 50% of the detonation shock wave, in the square prism configuration, is directed upwards above the midpoint plane and does not contribute to the pressure pulse directed downward to the buried mines. In contrast, when the configuration of the explosive blocks is made in a triangular prism form and also initiated from the center, there is 13% increase in the explosive (1.32 lbs vs. 1.49 lbs) below the midpoint plane, as illustrated in FIG. 6D. In addition, the triangular prism has a much larger contact area with the ground, see FIGS. 6G and 6H, which can result in higher energy transfer into the ground making for more efficient mine clearance—the area in contact with ground is 22.3 in2 compared with 13.4 in2 (66% increase).

Turning now to the second embodiment, as mentioned above and as will be described as follows with references to FIGS. 7-9B, in the second embodiment, the explosive block can be in the shape of any prism. Like the first embodiment, a detonating cord can extend from the prism's first face to its second face. Unlike the first embodiment, the detonating cord can be located above the center/centroid plane of the explosive block. Each explosive block has a parachute (either individual or shared) that will control its landing to ensure that the explosive block lands with the "right side up," with the detonating cord located above the center/centroid plane of the explosive block.

Figure 7:
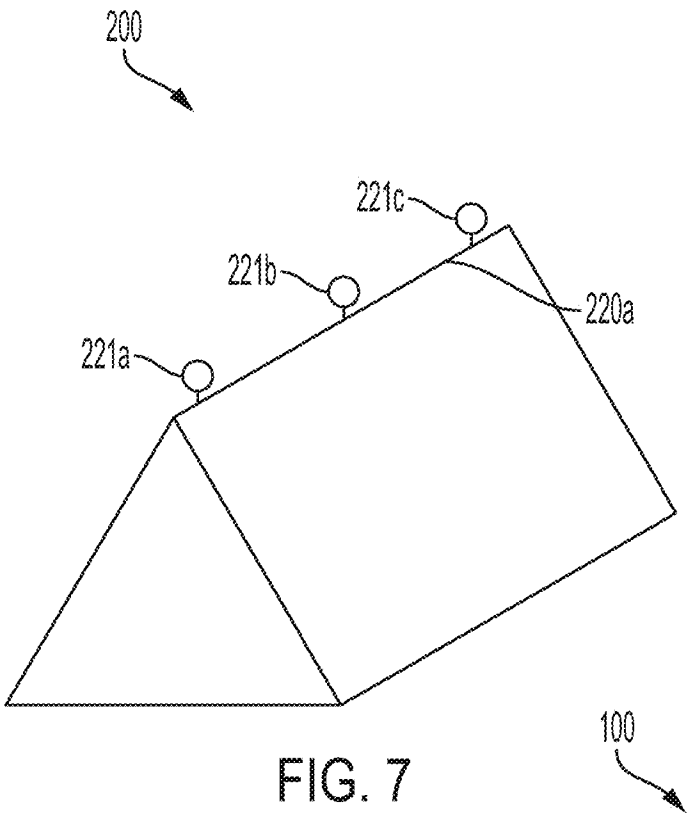
FIG. 7 is an illustration of an explosive block, according to an embodiment of the present disclosure.

Referring now to FIG. 7, FIG. 7 is an illustration of an explosive block 200, according to an embodiment of the present disclosure. In FIG. 7, loops 221 are installed at an edge 220*a* of the explosive block 200 having the shape of a triangular prism. The loops 221 can be any device through which a detonating cord 300 can extend. A non-exhaustive list of examples of possible loops 221 follow: an eye bolt, a hook, a cut out piece of metal with a hole in it.

Figure 8A:
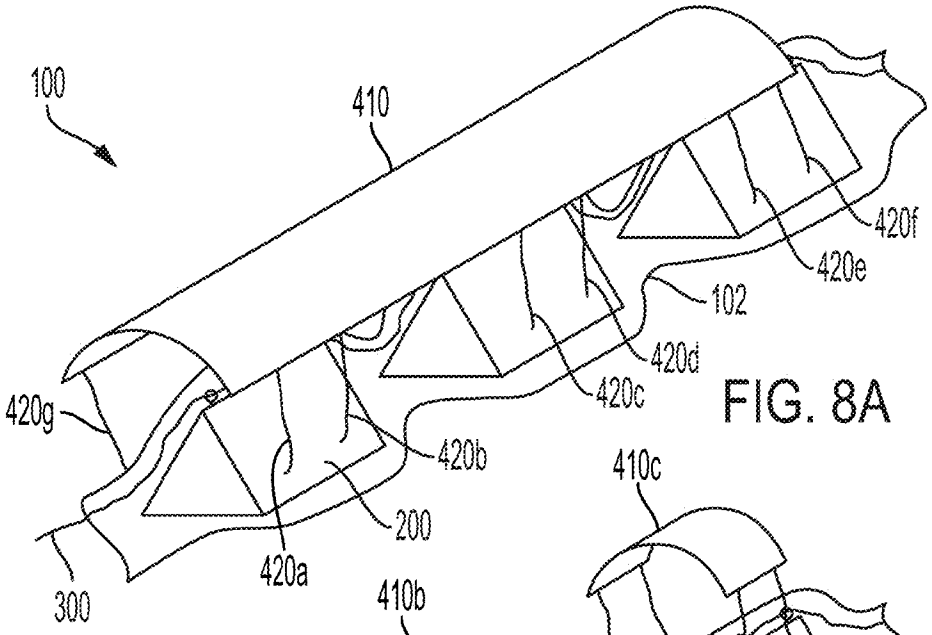
FIGS. 8A-8C are illustrations embodiments of MICLIC with parachutes or vane to guide the landing of the explosive blocks.
Figure 8B:
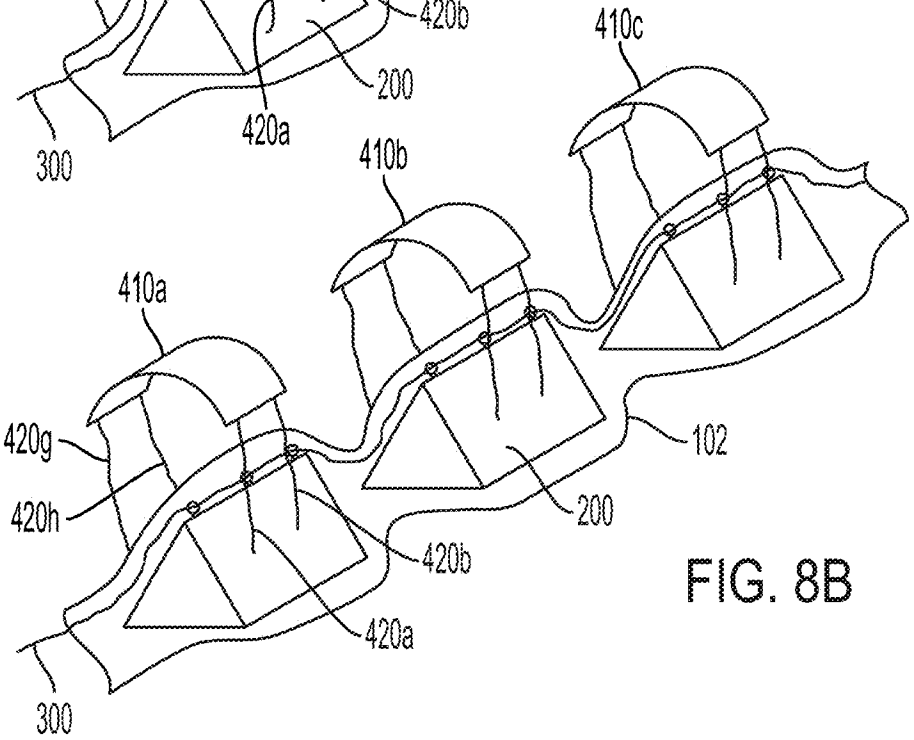
Figure 8C:
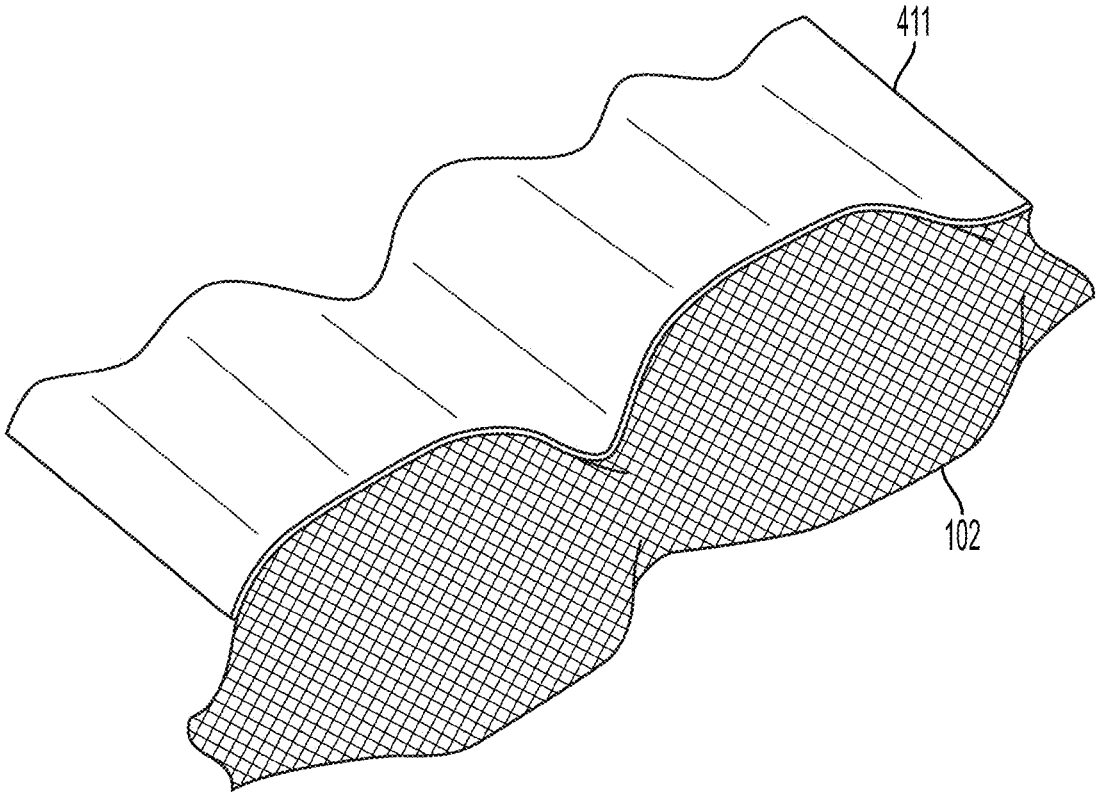

Referring now to FIGS. 8A-8C, FIG. 8A-8C are illustrations embodiments of MICLIC 100 with parachutes or a vane to guide the landing of the explosive blocks 200. As discussed above, it is an object of the disclosed subject matter to increase, and in some cases, maximize, the amount of explosive material between the ground and the detonating cord 211*b* when the explosive block 200 lands on the ground. To ensure (or improve that odds) that the explosive block 200 lands "right side up," with the detonating cord located above the center/centroid plane of the explosive block (i.e., such that the rectangular face opposite the edge 220*a* with the detonating cord is in contact with the ground), one or more parachutes can be used. For example, referring to FIG. 8A, in some embodiments, a MICLIC 100 can have one or more rectangular vanes 410 that cover one or more explosive blocks 200. Referring to FIG. 8B, in some embodiments, one or more of the explosive blocks 200 can have its own parachute 410. In some embodiments, a combination is used: one or more explosive blocks 200 has its own individual parachute 410 while two or more other explosive blocks 200 share a parachute 410.

The parachutes 410 can be attached to the explosive blocks 200 such that they guide the explosive blocks 200 to land "right side up," by any method known in the art. For example, in some embodiments, the parachutes could be attached the woven sleeve, as illustrated in FIGS. 8A and 8B.

In some embodiments, a vane of fabric of other material 411 attached to the sleeve 102 proximate to the top of the explosive bocks 200 can be used instead of a parachute, as illustrated in FIG. 8C. To illustrate how this works, compare it to a flag attached to a flagpole. As the flag and the flagpole fall, the pole will strike the ground first due to the drag on the flag. Similarly, by using a long vane of fabric or other material 411 attached to an area proximate the top of the explosive blocks 200, the bottom of the explosive blocks 200 will strike the ground first. In these embodiments, the detonating cord 300 could pass through a hole or loop at or near the top of an explosive block 300, as described above. In addition, the detonating cord 300 could be attached to the base of the vane of fabric of other material 411, where the vane 411 attaches to the sleeve 102.

Figure 9B:
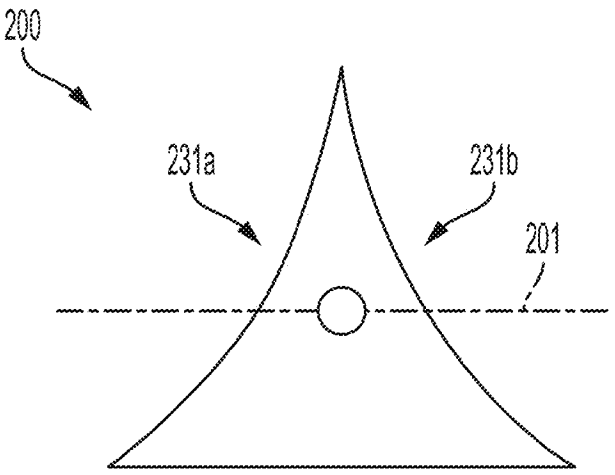
FIG. 9B is an illustration of an explosive block with rectangular faces that curve inward, according to an embodiment of the present disclosure.
Figure 9A:
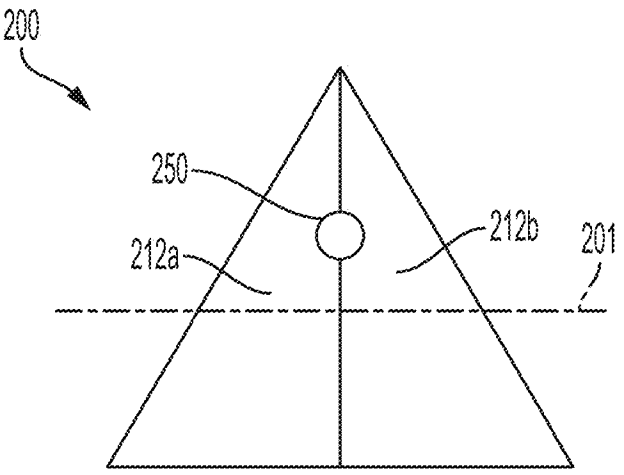
FIG. 9A is an illustration of an explosive block with a hole a centroid plane, according to an embodiment of the present disclosure.

While FIGS. 7-8B each illustrate explosive blocks in the shape of a triangular prism, the subject matter disclosed herein is not so limited. Instead, as one of ordinary skill in the art will appreciate, any rectangular prism can be used provided that a parachute can be attached to it, and loops 221 can be placed proximate to a "top" of the prism. Further, while FIGS. 7-8B each illustrate a fastener installed on an edge of an explosive block, the invention is also not so limited in this respect. For example, the explosive block 200 can have a hole from one of its faces to the other at a location above the center/centroid plane, as illustrated in FIG. 9A.

To further minimize the explosive material above the detonating cord (which in some embodiments, corresponds with a hole 250 through the explosive block 200), some designs alter the geometry of the prism to minimize explosive material above the detonating cord. For example, referring to FIG. 9B, two of the rectangular faces 231 of the triangular prism 200 curve inward. In this way, there is even less material above the detonating cord's horizontal plane 201. As one of ordinary skill in the art will appreciate, other alterations are possible.

Like the first embodiment, the explosive blocks 200 of the second embodiment can be arranged along a detonating cord 300, placed into a sleeve 102, and pinched off with fasteners 101. In those embodiments, the parachutes 410 may be attached to the sleeve 102 itself or, alternatively, small holes can be cut through the sleeve 102 through which the parachute 410 attachment features can attached directly to an explosive block 200.

While various illustrative embodiments incorporating the principles of the present teachings have been disclosed, the present teachings are not limited to the disclosed embodiments. Instead, this application is intended to cover any variations, uses, or adaptations of the present teachings and use its general principles. Further, this application is intended to cover such departures from the present disclosure that are within known or customary practice in the art to which these teachings pertain.

In the above detailed description, reference is made to the accompanying drawings, which form a part hereof. In the drawings, similar symbols typically identify similar components, unless context dictates otherwise. The illustrative embodiments described in the present disclosure are not meant to be limiting. Other embodiments may be used, and other changes may be made, without departing from the spirit or scope of the subject matter presented herein. It will be readily understood that various features of the present disclosure, as generally described herein, and illustrated in the Figures, can be arranged, substituted, combined, separated, and designed in a wide variety of different configurations, all of which are explicitly contemplated herein.

The flowchart in the figures illustrates the operation of possible implementations of systems and methods according to various embodiments of the present technical solutions. In this regard, each block in the flowchart can represent portion of instructions. In some alternative implementations, the functions noted in the blocks can occur out of the order noted in the figures. For example, two blocks shown in succession can, in fact, be executed substantially concurrently, or the blocks can sometimes be executed in the reverse order, depending upon the functionality involved.

A second action can be said to be "in response to" a first action independent of whether the second action results directly or indirectly from the first action. The second action can occur at a substantially later time than the first action and still be in response to the first action. Similarly, the second action can be said to be in response to the first action even if intervening actions take place between the first action and the second action, and even if one or more of the intervening actions directly cause the second action to be performed. For example, a second action can be in response to a first action if the first action sets a flag and a third action later initiates the second action whenever the flag is set.

The present disclosure is not to be limited in terms of the particular embodiments described in this application, which are intended as illustrations of various features. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. It is to be understood that this disclosure is not limited to particular methods, compounds, or compositions, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

In addition, even if a specific number is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, sample embodiments, or drawings, should be understood to contemplate the possibilities of including one of the terms, either of the terms, or both terms. For example, the phrase "A or B" will be understood to include the possibilities of "A" or "B" or "A and B."

In addition, where features of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art all language such as "up to," "at least," and the like include the number recited and refer to ranges that can be subsequently broken down into subranges as discussed above. Finally, as will be understood by one skilled in the art, a range includes each individual member. Thus, for example, a group having 1-3 components refers to groups having 1, 2, or 3 components. Similarly, a group having 1-5 components refers to groups having 1, 2, 3, 4, or 5 components, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A mine clearing device configured to be propelled into an area and detonated after landing, the mine clearing device comprising:

a detonating cord; and a plurality of explosive blocks having a triangular prism shape arranged along the detonating cord, wherein each of the plurality of explosive blocks is configured such that, upon landing, a majority of an explosive material is between a ground and a horizontal plane of the detonating cord.

2. The mine clearing device of claim 1, wherein each of the explosive blocks comprises a plurality of segments that together form a respective explosive block.

3. The mine clearing device of claim 1, wherein the triangular prism shape comprises:

a first rectangular face;

a second rectangular face; and a third rectangular face, wherein the first and second rectangular faces are curved inward such that there is less volume above a centroid plane parallel with the third rectangular face.

4. The mine clearing device of claim 1, wherein each explosive block forms therethrough an aperture through which the detonating cord extends, and wherein the aperture extends from a first triangular face a respective explosive block to a second triangular face of the respective explosive block.

5. The mine clearing device of claim 4, wherein the aperture extends from a first location of the first triangular face to a second location on the second triangular face, wherein the first location is at one of a first centroid and between the first centroid and a first corner, and wherein the second location is at one of a second centroid and between the second centroid and a second corner.

6. The mine clearing device of claim 1, wherein each of the plurality of explosive blocks further comprise a plurality of loops arranged along an edge of the explosive block through which the detonating cord extends, and wherein the mine clearing device further comprises:

one or more parachutes configured such that each of the plurality of explosive blocks is configured to land on a face opposite of the edge.

7. The mine clearing device of claim 6, wherein one or more of the parachutes comprise a rectangular parachute vane extending over two or more of the plurality of explosive blocks.

8. The mine clearing device of claim 7, wherein the one or more parachutes comprise a plurality of parachutes, each of the plurality of parachutes extending over only a respective one of the plurality of explosive blocks.

9. The mine clearing device of claim 6, further comprising:

a sleeve surrounding each of the plurality of explosive blocks; and a fabric vane having one end thereof attached to the sleeve to cause drag as the mine clearing device falls to the ground.

10. A method of manufacturing a mine clearing device to be propelled into an area and detonated after landing, the method comprising:

preparing, by an extrusion process, a plurality of explosive blocks, wherein each of the plurality of explosive blocks have a triangular prism shape; and arranging each of the plurality of explosive blocks along a detonating cord.

11. The method of claim 10, wherein preparing one of the plurality of explosive blocks comprises:

extruding a plurality of segments that together form a triangular prism with an aperture that extends from a first centroid at a first triangular face to a second centroid at a second triangular face, wherein arranging each of the plurality of explosive blocks along the detonating cord comprises securing the plurality of segments together about the detonating cord such that the detonating cord extends through the aperture.

12. The method of claim 11, wherein each of the plurality of segments are substantially identical.

13. The method of claim 10, further comprising:

attaching a plurality of loops on an edge of each of the explosive blocks, wherein arranging each of the plurality of explosive blocks along the detonating cord comprising extending the detonating cord through each of the plurality of loops of each of the explosive blocks;

placing a sleeve around each of the plurality of explosive blocks; and attaching one or more parachutes to the sleeve such that the one or more of the plurality of explosive blocks is configured to land on a face opposite the edge.

14. The method of claim 13, wherein one of the one or more parachutes comprises a rectangular parachute vane and attaching the one or more parachutes to one or more of the plurality of explosive blocks comprises:

attaching the rectangular parachute vane to the sleeve such that the rectangular parachute vane extends over the at least two of the plurality of explosive blocks.

15. The method of claim 10, further comprising:

placing a sleeve around each of the plurality of explosive blocks; and attaching one end of a fabric vane to the sleeve to cause drag as the mine clearing device falls to the ground.

16. An explosive block for use in a mine clearing line charge device configured to be propelled into an area and detonated after landing, the explosive block comprising:

a block in a triangular prism shape and comprising an explosive, wherein the block is configured to be arranged along a detonating cord.

17. The explosive block of claim 16, wherein the block forms therethrough an aperture through which the detonating cord can extend, wherein the aperture extends from a first location of a first triangular face to a second location on a second triangular face, wherein the first location is at one of a first centroid and between the first centroid and a first corner, and wherein the second location is at one of a second centroid and between the second centroid and a second corner.

18. The explosive block of claim 16, wherein the block further comprises a plurality of loops arranged along an edge of the explosive block through which the detonating cord can extend.

19. The explosive block of claim 16, wherein the triangular prism shape comprises:

a first rectangular face;

a second rectangular face; and a third rectangular face, wherein the first and second rectangular faces are curved inward such that there is less volume above a centroid plane parallel with the third rectangular face.

20. The mine clearing device of claim 9, further comprising one or more fasteners configured to pinch at least a portion of the sleeve.

* * * * *